US007083556B1

(12) United States Patent
Miskech

(10) Patent No.: US 7,083,556 B1
(45) Date of Patent: Aug. 1, 2006

(54) EXERCISE APPARATUS

(76) Inventor: Pete Miskech, 115 Lakes Village Blvd., Dearborn, MI (US) 48120

( * ) Notice: Subject to any disclaimer, the term of this patent is extended or adjusted under 35 U.S.C. 154(b) by 327 days.

(21) Appl. No.: 10/625,488

(22) Filed: Jul. 23, 2003

(51) Int. Cl.
*A63B 26/00* (2006.01)
*A63B 71/00* (2006.01)

(52) U.S. Cl. ..... 482/140; 482/142; 482/148

(58) Field of Classification Search ..... 482/140–142, 482/148, 62; 602/32, 40; D21/665, 676, D21/682, 686, 690
See application file for complete search history.

(56) References Cited

U.S. PATENT DOCUMENTS

2002/0119871 A1* 8/2002 Fulks ..... 482/93
2003/0087736 A1* 5/2003 Carter et al. ..... 482/142
2003/0087737 A1* 5/2003 Studdard ..... 482/142

* cited by examiner

*Primary Examiner*—Lori Amerson
(74) *Attorney, Agent, or Firm*—Law Offices of John Chupa & Associates, P.C.

(57) ABSTRACT

An exercise apparatus 10 comprising a plurality of ergonomically contoured body pads (47, 48, 49, 50, 56, 58, 60, 64, 65), a pair of substantially identical frame arms (80) which are each removably coupled to a double cardan joint (100). Particularly, each respective double cardan joint (100) is coupled to a center beam (28) which rotates to a respective side upon a user actuating a respective one of the pair of frame arms (80), thereby affording a user a substantially safe exercise that is conducted in both a compression and a tensile mode of motion.

8 Claims, 5 Drawing Sheets

EXERCISE APPARATUS

FIELD OF THE INVENTION

The present invention generally relates to an exercise apparatus and, more particularly, an exercise apparatus which strengthens, tones, and stretches certain muscles of the body in a tensile mode while concomitantly reducing the potentiality of bodily injury.

BACKGROUND OF THE INVENTION

Conventional exercise equipment, such as and without limitation, free weights, universal machines (i.e., an exercise machine which incorporates several exercise assemblies within one machine), and/or the like are conventionally used in order to strengthen and/or tone various muscles of a body. Oftentimes, the conventional exercise equipment necessitates a relatively large amount of athleticism and dexterity in order to utilize the equipment in a safe and designed manner.

For example and without limitation, conventional free weights require a user to lift a certain amount of weight which is attached to a bar. Typically, the user must squat down (i.e., bending at the knees and keeping a straight back), grasp the bar having the weight attached thereto, utilize the various muscles in the legs, thighs, and buttocks, as well as the shoulders, arms, hands, chest, and back to hold, support, and lift the weight off of the ground or rack while concomitantly utilizing the same muscles to maintain balance and correct form (i.e., there are many different forms to safely lift weight and, each of which are solely dependant upon the exercise) in order not to pull or tear a muscle, pinch or damage a nerve, tear or sprain a tendon or ligament, and/or even break a bone.

In further example and without limitation, a conventional universal machine typically requires a user to freely stand or sit/lay upon a seat/bench. Although sitting or lying does not require a user to squat to pickup the weight as mentioned above, the user must also utilize the abovementioned muscles to support, stabilize, and lift/pull/push the weight in a designed manner in order to tone or strengthen muscles. Substantially any exercise involving the lifting of weight places a larger than normal amount of stress (i.e., a normal amount of stress being the amount of stress upon the body while the body is not lifting weight) upon the muscles, joints, tendons, ligaments, and the like. Therefore, lifting weights of any kind (e.g., free weights, universal machine weights, and/or the like) requires a great amount of athleticism, dexterity, and even initial strength.

Moreover, the lifting of weights or even the lifting of one's own body (i.e., push-ups, chin-ups, sit-ups, and/or the like) does not typically stretch the muscles, ligaments, tendons, and/or the like. Stretching of the muscles can only be accomplished in a tensile mode or motion, whereas lifting weights is done in a compression mode or motion (i.e., a tensile mode is a substantially opposite motion than that of a compression mode).

Lastly, a compression mode or motion, as discussed above, can be very harmful to a body if the motion is not performed correctly. This is especially true in individuals which are physically challenged or debilitated, such as and without limitation, elderly individuals or even geriatric individuals (e.g., muscle degradation, joint degradation, bone degradation, and/or the like are common influences of the aging process).

There is therefore a need for an apparatus which allows an individual to stretch, strengthen, and tone muscles in a convenient and safe manner. There is also a need for an apparatus which allows an individual of substantially any age to stretch, strengthen, and tone muscles in a tensile mode and in a convenient and safe manner, and which overcomes some or all of the previously delineated drawbacks of prior exercise apparatuses.

SUMMARY OF THE INVENTION

A first non-limiting advantage of the present invention is that it provides an apparatus which allows for the selective exercise of an individual in a manner which overcomes the previously delineated drawbacks of prior exercise apparatuses.

A second non-limiting advantage of the present invention is that it provides an apparatus which allows for the selective exercise of an individual in a manner which overcomes the previously delineated drawbacks of prior exercise apparatuses and, more particularly, allows for the exercise of an individual in a tensile mode while concomitantly supporting the individual's body in an ergonomic and comfortable semi-prone position.

A third non-limiting advantage of the present invention is that it provides an apparatus which may be selectively adjusted to comfortably receive, support, and permit an individual of substantially any size, weight, height, and or the like to selectively exercise his/her body in the tensile mode.

A fourth non-limiting advantage of the present invention is that it provides an exercise apparatus. Particularly, the exercise apparatus comprises a first rigid frame assembly; a second selectively rotatable frame assembly which is coupled to the first rigid frame assembly; a seat portion which is coupled to the second selectively rotatable frame assembly; a pair of independent and selectively rotatable handle portions; and a pair of high tension cables, wherein a movement of a first handle of the pair of handles causes the seat portion to rotate in a first direction, and wherein a movement of a second handle causes the seat portion to rotate in a second direction.

A fifth non-limiting advantage of the present invention is that it provides an exercise apparatus. Particularly, the exercise apparatus comprises a frame assembly having a first side frame rail, a second side frame rail, a top frame rail, a bottom frame rail, a first pair of support pillars, and a second pair of support pillars; a generally triangular base assembly having a channel of a first diameter, the channel including at least one bearing; at least one selectively rotatable center beam which is rotatably disposed within the reception portion; a fixed center beam having a first end and a second end; an axle which is coupled to the fixed center beam such that the center beam is perpendicular to the axle; a pair of joints which are coupled to the at least one selectively rotatable center beam; a pair of substantially identical arm frames which are each rotatably mounted upon the axle; and a pair of substantially identical high tension cables which are each respectively coupled to one of the pair of frame arms and to one of the pair of joints, wherein a movement of a first arm frame of the pair of arm frames causes the at least one selectively rotatable center beam to rotate in a first direction, and wherein a movement of a second arm frame of the pair of arm frames causes the at least one selectively rotatable center beam to rotate in a second direction.

A sixth non-limiting advantage of the present invention is that it provides a method for exercising an individual in both a tensile and a compression mode. Particularly, the method comprises the steps of providing a first rigid frame assembly; providing a second selectively rotatable frame assembly and coupling the second selectively rotatable frame to the first rigid frame assembly; providing a seat portion and coupling the seat portion to the second selectively rotatable frame assembly; providing a pair of independent and selectively rotatable handle portions; providing a pair of high tension cables and coupling the pair of high tension cables to a respective one of the pair of selectively rotatable handle portions; causing a movement of a first handle of the pair of handles to rotate the seat portion in a first direction; and causing a movement of a second handle of the pair of handles to rotate causes the seat portion to rotate in a second direction.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
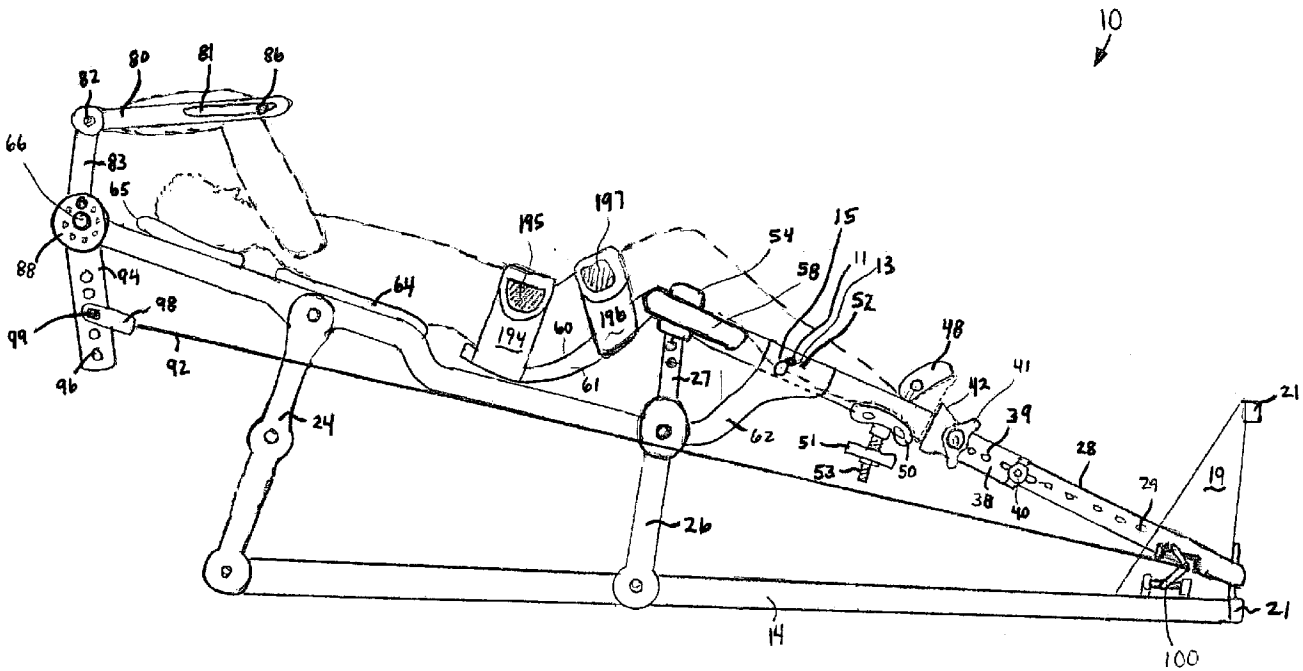
FIG. 1 is a side view of an individual utilizing an exercise apparatus which is made in accordance with the teachings of the preferred embodiment of the invention.
Figure 2:
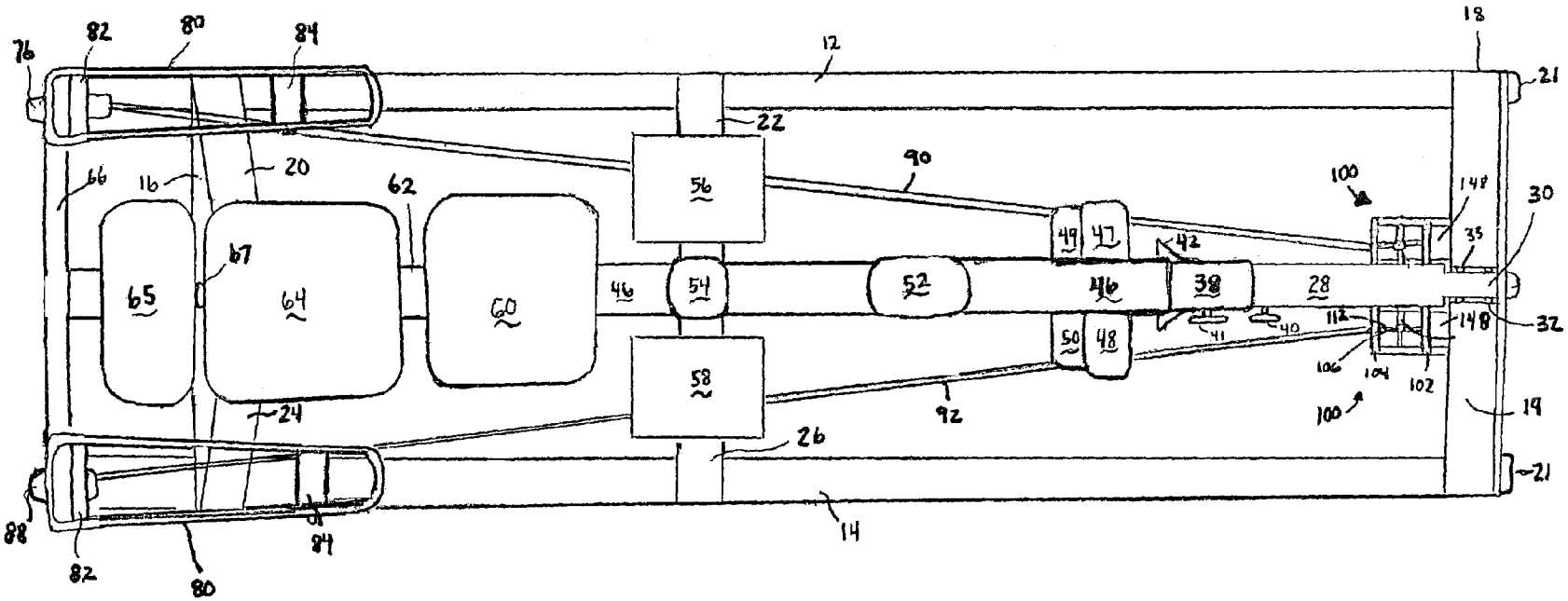
FIG. 2 is a top view of the apparatus which is shown in FIG. 1.

Referring now to FIGS. 1–2, there is shown an exercise apparatus 10 which is made in accordance with the teachings of the preferred embodiment of the invention. As shown the apparatus 10 includes a generally rectangular base frame comprising a first side frame rail 12, a second side frame rail 14, a top frame rail 16, and a bottom frame rail 18. The apparatus 10 further includes a first support pillar 20, a second support pillar 22, a third support pillar 24, and a fourth support pillar 26, each of which, as will be discussed further below, cooperatively support several adjoined center beams 28, 38, 46, 62.

Apparatus 10 also includes a generally triangular base support 19 having a plurality of "non-marking" anti-slip pads 21 which allow the apparatus 10 to be elevated, such that the pads 21 are in contact with a floor surface (e.g., substantially any desired surface, such as concrete, carpet, tile, and/or the like) and the side support rails 12, 14 are generally perpendicular to the desired floor surface. In this manner, a user may conveniently stand the apparatus 10 in an upright position which allows the apparatus 10 to be stored within a corner of a room, in a closet, or the like.

Apparatus 10 further includes a plurality of body support pads 56, 58, 60, 64, 65 which are coupled to the several adjoined center beams 28, 38, 46, 62, and which are geometrically configured and ergonomically formed to comfortably receive a human body. That is, the support pads 56, 58 are generally rectangular in shape, although other shapes may be used, and are designed to comfortably receive and support the thighs and legs of a user. The support pad 60 is generally "spoon" shaped and is designed to comfortably receive and support the buttocks of a user. The support pad 64 is generally square in shape and is designed to comfortably receive and support a back of a user. Lastly, the support pad 65 is generally rectangular in shape and is designed to comfortably receive and support the neck and head of a user.

As briefly discussed above, the apparatus 10 also includes several center beams 28, 38, 46, 62. Particularly, the center beam 28 is generally tubular in shape and includes a tapered portion 30 which has a diameter that is less than the diameter of the beam 28. More particularly, the tapered portion 30 of the beam 28 is movably coupled within a cavity 32 of the generally triangular base 19. That is, in one non-limiting embodiment, the cavity 32 may include at least one bearing, such as bearing 33, which allows the beam 28 (i.e., the tapered portion 30 of the beam 28) to rotatably move within the cavity 30. It should be appreciated that nothing within this description is meant to or should be construed as limiting the motion of the beam 28 to only rotational motion. Rather, as should be appreciated by one who is skilled in the relevant art, the beam 28 may also have the capability of being raised and lowered (i.e., not only can the beam 28 rotate about an axis, but the beam can also raise and lower in a plane of the axis about which it rotates).

The center beam 28 further includes a plurality of apertures 29 which traverses through the entire beam 28, such that a pin, such as and without limitation, pin 40 may be disposed through the entire beam 28 via the plurality of apertures 29.

The center beam 38 is generally tubular in shape and has a diameter which is greater than the diameter of the beam 28. Moreover, the beam 38 includes a plurality of apertures 39 which traverse through the entire beam 38, such that a pin, such as and without limitation, pin 41 may be disposed through the entire beam 38 via the plurality of apertures 39. Further, the beam 38 is sized to conformingly receive the beam 28 (i.e., the beam 28 is movably disposed inside of the beam 39), effective to allow the beams 28, 38 to be adjusted to substantially any desired length and removably coupled at substantially any desired length by use of the pins 40, 41. the beam 38 further includes a generally trapezoidal extension collar 42 which is fixedly coupled to the beam 38, and which allows a user to securely rest his/her feet upon the collar 42.

The center beam 46 is generally tubular and includes a spoon shaped portion 61. More particularly, the center beam has a diameter which is greater than the diameter of the beam 38 and, in this manner, the beam 46 is sized to conformingly receive the beam 38 (i.e., the beam 38 is movably disposed inside the beam 46), effective to allow the beams 38, 46 to be adjusted to substantially any desired length and removably coupled at substantially any desired length by use of the pin 41.

The center beam 46 further includes a first foot pad 47 which is disposed above and to the side of the beam 46 which is in close proximity to the rail 12. Beam 46 also includes a second foot pad 48 which is disposed above and to the side of the beam 46 which is in close proximity to the rail 14 (i.e., the foot pads 47, 48 are disposed on opposite sides of the beam 46 and are also slightly elevated above the beam 46). It should be appreciated that the foot pads 47, 48 are ergonomically formed to comfortably receive the top portion of a user's feet The center beam 46 further includes a first Achilles' pad 49 (i.e., the first Achilles' pad 49 is ergonomically shaped to comfortably receive and support the Achilles' tendon and heel area of a user's left foot and leg) which is disposed slightly below and to the side of the beam 46 which is in close proximity to the rail 12, and which cooperates with the foot pad 47 and the collar 42 to comfortably support and immobilize the left foot of a user.

The center beam 46 further includes a second Achilles' pad 49 (i.e., the second Achilles' pad 49 is ergonomically shaped to comfortably receive and support the Achilles' tendon and heel area of a user's right foot and leg) which is disposed slightly below and to the side of the beam 46 which is in close proximity to the rail 12, and which cooperates with the foot pad 48 and the collar 42 to comfortably support and immobilize the right foot of a user.

The first and second Achilles' pads 49, 50 each further include a threaded male fastening device 53 which is movably coupled to the bottom side of each of the Achilles' pads 49, 50, and each of which receive a female threaded fastening device 51 which may be rotated in either direction (i.e., clockwise or counter-clockwise) to either raise or lower the Achilles' pads 49, 50. In this manner, a user may selectively adjust the height of the Achilles' pads 49, 50 to a height which conformingly receives the user's Achilles' heel and tendon area. It should be appreciated that the selectively adjustable Achilles' pads 49, 50 allow substantially any sized user (e.g., ranging from a very small user to a very large user) to selectively isolate and comfortably support his/her feet.

The center beam 46 further includes a first generally rectangular thigh pad 56 which may be coupled to the beam 46, to the pillar 27, or to the pillar 22 in close proximity to the rail 12. In the preferred embodiment of the invention, however, the thigh pad 56 is coupled to the pillar 27, as will be discussed in detail further below. The beam 46 also includes a second generally rectangular thigh pad 58 which may be coupled to the beam 46, to the pillar 27, or to the pillar 26 in close proximity to the rail 14. In the preferred embodiment of the invention, however, the thigh pad 58 is coupled to the pillar 27 in substantially the same manner as the thigh pad 58.

That is, the apparatus 10 further includes a center beam 62 which is movably coupled to the beam 46 by use of a first sleeve 52 which allows the center beams 28, 38, and 46 to be adjusted to substantially any desired length and to rotatably move in either a clockwise or counter-clockwise motion inside the cavity 32 and the first sleeve 52 while continually being supported by the beam 56. The beam 62 is further movably coupled to a swing arm pillar 27 which allows the beam 46 to be optimally supported (i.e., "optimally supported" hereinafter refers to the support point upon the center beam 46 which, when supported, provides the greatest stability and support to the beam 46). That is, the swing arm pillar 27 further includes a second sleeve 54 which is movably coupled around the beam 46 and, in this manner, the second sleeve may be selectively adjusted to optimally support the beam 46 when the adjoined center beams 28, 38, 46 are at any and all adjusted and desired lengths.

In one non-limiting embodiment of the invention, the beam 46 may include a through aperture 11 which is formed directly beneath the collar portion 52 and the collar portion 52 may also include a through aperture 13 which is substantially aligned with the through aperture 11 of the center beam 46. In this manner, a conventional "pull pin", such as pin 15 may be selectively and removably inserted through the collar 52 and through the beam 46, thereby retarding any rotational movement of the center beam 46. It should be appreciated that an individual may easily and conveniently reach the pin 15 while having his/her body isolated within the apparatus 10. It should be understood that the location of the apertures 11, 13 and the pull pin 15 are not limited to that which is described above or shown within FIG. 1. Rather, the location upon the apparatus 10 of the apertures 11, 13 and the pin 15 are merely for descriptive and illustrative purposes only and that the pin 15 and the apertures 11, 13 may be disposed upon the center beams 28, 38, 46 in substantially any desired location. It should also be understood that in other non-limiting embodiments of the invention, other assemblies for retarding the rotation of the beams 28, 38, 46 may also be employed (e.g., a selectively removable joint locking assembly which may be disposed upon the joints 100, a selectively depressible release button which may engage one of the beams 28, 38, 46, as well as another portion of the apparatus 10, and/or the like).

The center beam 46 also includes a generally arcuate and ergonomically shaped buttocks pad 60 which is coupled to the generally spoon shaped portion 61 of the center beam 46, and which is adapted to comfortably receive and support a user's buttocks and upper thigh area. It should be appreciated that the generally spoon shaped portion 61 of the center beam 46 allows a user to position themselves in a substantially prone body position while having the thighs and lower legs raised above the hips. In this manner, the user is placed into a well known position which is oftentimes called the "shock" or "anti-shock" position, and in this position, the user has a greater amount of oxygen and blood being transported to the major organs of the body (e.g., heart, lungs, kidneys, stomach, and the like), thereby allowing individuals, such as and without limitation, elderly, geriatric, overweight, and/or the like individuals to utilize the apparatus while concomitantly increasing blood circulation to the vital organs of the individuals body. That is, the shock position shunts a portion of the blood and oxygen from the legs of the individual and allows the vital organs which are located in the torso of the individual to benefit from a greater amount of blood and oxygen, thereby allowing substantially any individual, despite of age, build, weight, and/or the like to benefit from the apparatus 10.

It should be appreciated that the generally spoon shaped portion 61 of the center beam 46 is suspended above the center beam 62 by use of the swing arm pillar 27 and, in this manner, only the center beams 28, 38, and 46 are selectively rotatable. That is the beam 62 is fixedly coupled to the support pillars 20, 22, 24, and 26, therefore the beam 62 cannot move, and therefore the only portions of an user's body that may be selectively rotated (i.e., when a user is positioned properly within the apparatus 10) are the portions of the user's body which are in close proximity to and below the user's small of the back (i.e., rotation occurs from the user's small of the back to the user's heels).

In one non-limiting embodiment of the invention, the center beam 46 further includes a first support strap 194 having a conventional fastening device 195, such as and without limitation, a conventional hook and pile type fastening device, which is coupled to the buttocks pad 60, and which is adapted to wrap around a user's waist and substantially prevent lateral or side-to-side movement of the user's buttocks within the buttocks pad 60.

Further, in this non-limiting embodiment of the invention, the center beam 46 also may include at least one second support strap 196, such as and without limitation, a conventional hook and pile type fastening device, which is coupled to the buttocks pad 60, and which is adapted to wrap around at least one thigh of a user and substantially prevent lateral or side-to-side movement of the at least one thigh of the user within the buttocks pad 60. In other non-limiting embodiments, two substantially identical support straps which are substantially similar to the at least one second support strap 196 may be employed to each comfortably receive and isolate a respective one of a user's thighs.

The center beam 62 also includes a generally rectangular back pad 64 which is coupled to the beam 64, and which is adapted to comfortably receive and support a user's back (i.e., the back pad comfortably supports the user from the shoulders through the small of the back). The center beam 62 also includes a generally rectangular head pad 65 which is coupled to the beam 62, and which is adapted to comfortably receive and support a user's head.

Figure 5:
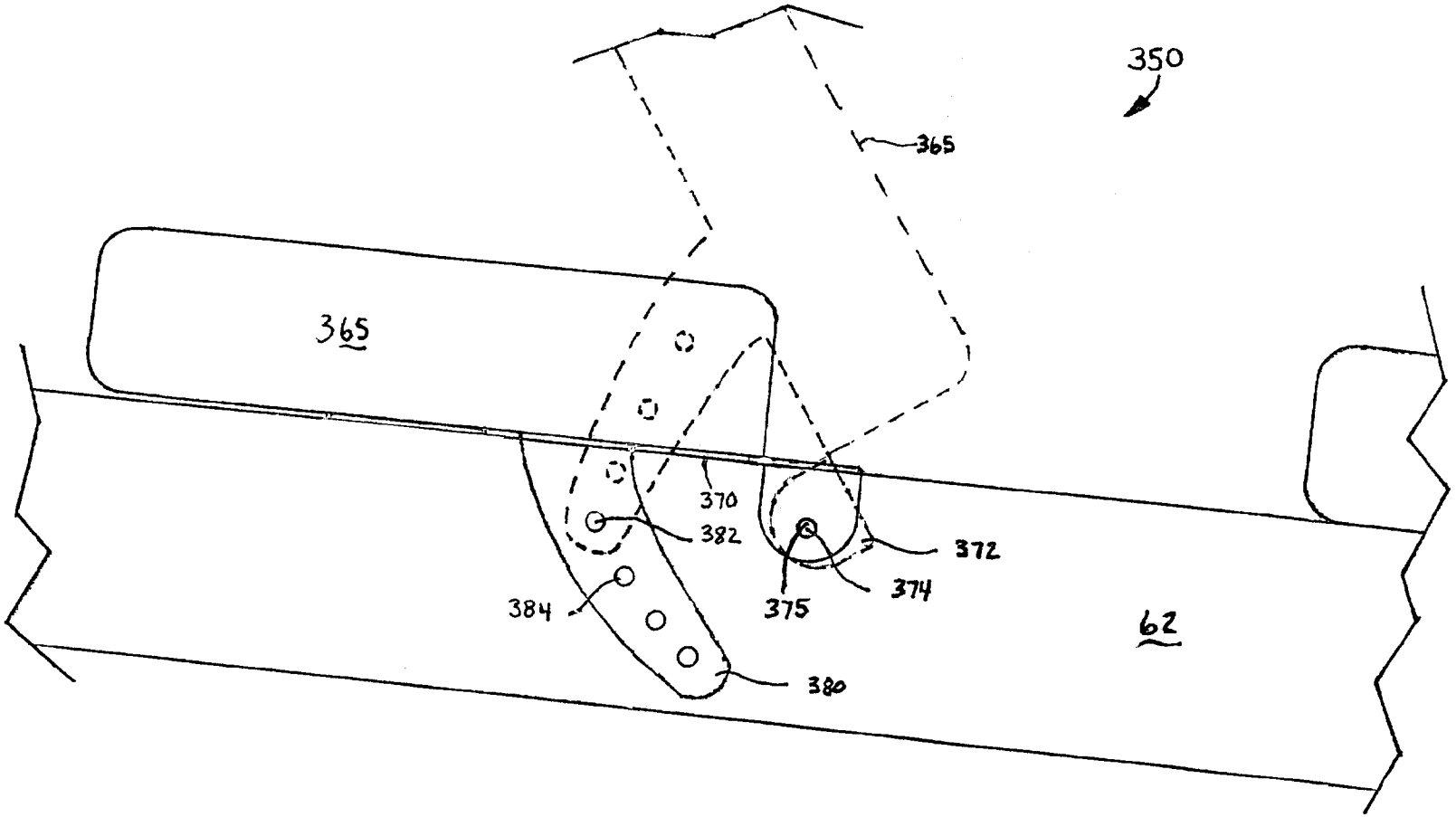
FIG. 5 is a side view of a head pad which is made in accordance with the teachings of an alternate embodiment of the invention.

Referring now to FIG. 5, there is shown a selectively movable head pad assembly 350 which is made in accordance with the teachings of an alternate embodiment of the invention. As shown, the assembly 350 includes a head pad 365 which is fixedly coupled to a pivot and guide bracket 370. The bracket 370 includes a generally arcuate projection 372 having an aperture 374 and a guide projection 380 having a plurality of apertures 384. Particularly, the aperture 374 may have a pin (not shown) deposited therethrough. Moreover, in this alternate embodiment, the beam 62 includes a first aperture 375 which traverses through the entire beam 62 and a second aperture 382 which traverses through the entire beam 62. In this manner, the pin (not shown) may be deposited through the aperture 374 of the bracket 370 and then through the first aperture 375 of the beam 62, thereby movably coupling the bracket 370, which is attached to the head pad 365, to the beam 62. A removable pin (not shown) may be deposited through the aperture 382 and then through one of the plurality of apertures 384, thereby either inclining the head pad 365 or declining the head pad 365 (i.e., the head pad 365 may be inclined or declined dependant upon which of the plurality of apertures 384 the removable pin (not shown) is deposited through). It should be appreciated that, in this manner, a user of the apparatus 10 may incline the head pad 365 to an angle which allows the user to look towards the base 19 (e.g., perhaps to watch a television while utilizing the apparatus 10) while the user's head is comfortably supported by the head pad 365.

The beam 62 includes a bar or axle 66 which is coupled to the beam 62. The axle 66 is further coupled through a first impact absorption bearing 76 which resides directly above the rail 12 and through a second impact absorption bearing 88 which resides directly above the rail 14. Particularly, the impact absorption bearings 76, 88 can move substantially free around the axle 66. It should be appreciated that the components which are connected, coupled, or attached to the bearing 88 are substantially identical to those components which are connected, coupled, or attached to the bearing 88, therefore the following description will be in reference to the bearing 88, as is best shown in FIG. 1.

The bearing 88 and the bearing 76 each include a first extension arm 83 which is attached to a frame arm 80. More particularly, each of the frame arms 80 are generally rectangular in shape and include a handle grip 82 and a movable elbow sling 84. Coupled to the opposite side of each of the bearings 76, 88 (i.e., the side of the bearings 76, 88 which is opposite of the first extension arms 83) is a second extension arm 94 that has a plurality of through apertures 96.

Figure 4:
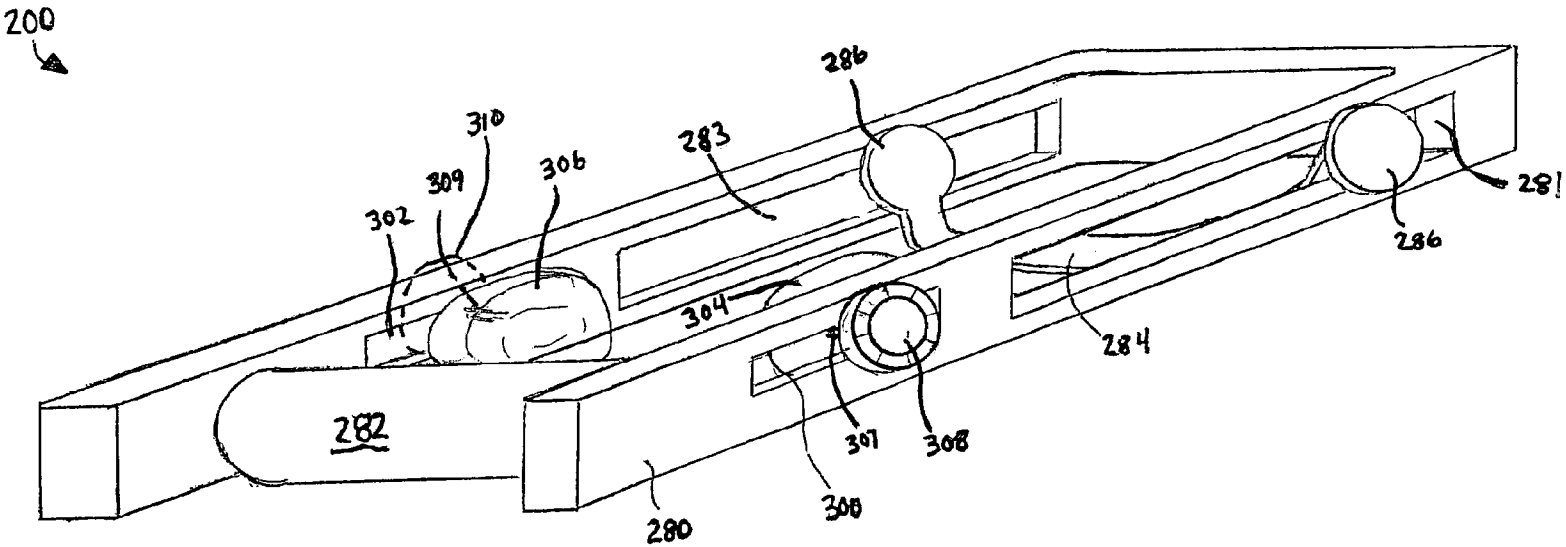
FIG. 4 is a perspective view of an arm frame which is made in accordance with the teachings of an alternate embodiment of the invention.

Referring briefly to FIG. 4, there is shown a frame arm 200 which is made in accordance with the teachings of an alternate embodiment of the invention. As shown, the frame arm 200 includes a generally "U" shaped frame portion 280 having a first pair of opposing slots 281, 283 and a second pair of opposing slots 300, 302. Particularly, the first pair of opposing slots receive a respective end 286 of an elbow sling 284 (i.e., the respective ends 286 are larger than the slots 281, 283, therefore the sling 284 may slide within the slots 281, 283 but not be removed from the arm 200).

The slot 300 includes a selectively adjustable and ergonomically contoured wrist pad 304. Particularly, the wrist pad 304 is coupled to a threaded fastening device 307 which is deposited through the slot 300 and threadingly coupled to a threaded dial 308. In this manner the dial 308, may be loosened and tightened, which allows a user to selectively adjust the pad 304 to a position which is comfortable for his/her wrist size.

The slot 302 includes a selectively adjustable and ergonomically contoured wrist pad 306 which is substantially similar to the wrist pad 304. Particularly, the wrist pad 306 is coupled to a threaded fastening device 309 which is deposited through the slot 302 and threadingly coupled to a threaded dial 310. In this manner the dial 310 may be loosened and tightened, which allows a user to selectively adjust the pad 306 to a position which is comfortable for his/her wrist size. The arm 200 further includes a handle grip 282 which may be wrapped with a substantially soft or malleable material. For example and without limitation, the handle grip 282 may be wrapped with foam, rubber, liquid filled bladder, and/or the like. It should be appreciated that a pair of arms 200 may be utilized in the place of the arms 80, which are illustrated in FIGS. 1–2.

The apparatus 10 further includes a first high tension cable 90 and a second high tension cable 92. Particularly, each of the cables 90, 92 further include an end cap 98 that has a through aperture 99 and an end loop 91. More particularly, the cable 90 is removably coupled to the second extension arm 94 (i.e., the second extension arm 94 which is coupled to the bearing 76) by use of the through aperture 98, a pin (not shown), and the plurality of through apertures 96 of the second extension arm 94. That is, a conventional pin (not shown) may be deposited through the through aperture 99 and then through one of the plurality of apertures 96, thereby coupling the high tension cable 90 to the second extension arm 94 which is attached to the bearing 76.

Figure 3:
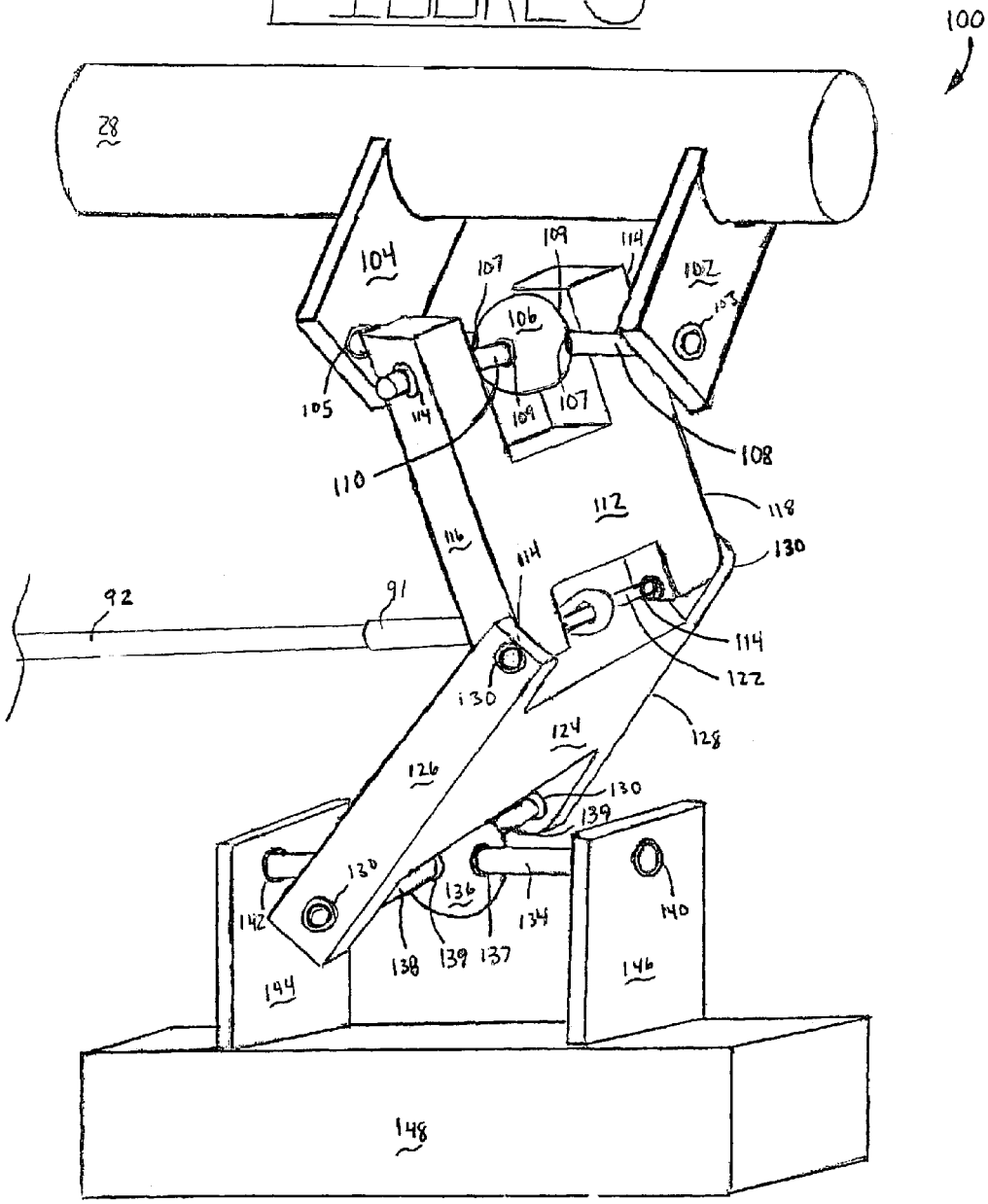
FIG. 3 is a perspective view of a double cardan joint which is made in accordance with the teachings of the preferred embodiment of the invention.

The end loop 91 of the cable 90 is coupled to a conventional double cardan joint, such as and without limitation, joint 100 which is shown in FIG. 3, as will be discussed in detail further below.

The cable 92 is removably coupled to the second extension arm 94 (i.e., the second extension arm 94 which is coupled to the bearing 88) by use of the through aperture 98, a pin (not shown), and the plurality of through apertures 96 of the second extension arm 94. That is, a conventional pin (not shown) may be deposited through the through aperture 99 and then through one of the plurality of apertures 96, thereby coupling the high tension cable 90 to the second extension arm 94 which is attached to the bearing 88.

The end loop 91 of the cable 92 is coupled to a conventional double cardan joint, such as and without limitation, joint 100 which is shown in FIG. 3, as will be discussed in detail further below.

It should be appreciated that, in this manner, the tension which a user applies to the cable 90, 92 may, be selectively determined by the position of the cable 90, 92 in respect to the second extension arm 94. That is, if the cable 90, 92 is coupled to the arm 94 through the lowest aperture 96 (i.e., the lowest aperture 96 hereinafter refers to the aperture of the arm 94 which is nearest to the surface upon which the apparatus 10 is disposed upon), the tension which the user applies to the cable 90, 92 must be greater than the tension the user applies to the cable 90, 92 when the cable 90, 92 is coupled to the highest aperture 96 (the highest aperture 96 hereinafter refers to the aperture 96 upon the arm 94 which is nearest to its respective joint 76, 88).

Referring now to FIG. 3, there is shown a double cardan joint 100 which is made in accordance with the teachings of the preferred embodiment of the invention. As shown, the joint 100 includes a first generally "H" shaped plate 112, a second generally "H" shaped plate 124, a first generally spherical cardan 106, and a second generally spherical cardan 136. Particularly, the first spherical cardan 106 includes a first pair of opposing apertures 107, which are formed through the first cardan 106, and a second pair of opposing apertures 109, which are formed through the first cardan 106. More particularly, the joint 100 further includes a first pin 108, which is disposed through the first pair of opposing apertures 107, and a second pin 110 which is disposed through the second pair of opposing apertures 109.

The second spherical cardan 136 includes a third pair of opposing apertures 137, which are formed through the first cardan 136, and a fourth pair of opposing apertures 139, which are formed through the first cardan 136. More particularly, the joint 100 further includes a third pin 134, which is disposed through the third pair of opposing apertures 137, and a fourth pin 110 which is disposed through the fourth pair of opposing apertures 138.

The first generally "H" shaped plate 112 further includes four identical through apertures 114, each of which are disposed through a respective one of the "legs" 116, 118 of the generally "H" shaped plate 112 (i.e., the term "legs" hereinafter refers to each respective end of the two vertical portions or sides of the "H" shaped plates 112, 124). Particularly, the second pin 108 which is disposed through the second opposing pair of apertures 109 is also disposed through two of the identical four apertures 114 which are resident through the upper portions of the legs 116, 118 of the "H" shaped plate 112, thereby movably coupling the first spherical cardan 106 to the first "H" shaped plate 112.

The second generally "H" shaped plate 124 further includes four identical through apertures 130, each of which are disposed through a respective one of the "legs" 126, 128 of the generally "H" shaped plate 124. Particularly, the fourth pin 138 which is disposed through the fourth opposing pair of apertures 139 is also disposed through two of the identical four apertures 130 which are resident through the lower portions of the legs 126, 128 of the "H" shaped plate 124, thereby movably coupling the second spherical cardan 106 to the second "H" shaped plate 124.

The center beam 28 of the apparatus 10 further includes a first projection portion 102 which is fixedly coupled to the beam 28 in a conventional manner (e.g., welded, bolted, and/or the like). The first projection portion includes a through aperture 103. The center beam 28 also includes a second projection portion 104 which is substantially identical to the first projection portion 102, and which is fixedly coupled to beam 28 in a conventional manner (e.g., welded, bolted, and/or the like). The second projection portion 104 includes a through aperture 105 which is substantially identical to the through aperture 103 of the first projection portion 102.

The first pin 108 which was disposed through the first pair of opposing apertures 107 is further disposed through the apertures 103, 105 of the respective first and second projection portions 102, 104, thereby movably coupling the first cardan 106 to the center beam 28.

The apparatus 10 further includes a first projection rail 148 which is fixedly coupled to the rail 18 in a position which is perpendicular to the rail 18 and in close proximity to as well as parallel to the center beam 28. The first projection rail 148 of the apparatus 10 further includes a third projection portion 144 which is fixedly coupled to the rail 148 in a conventional manner (e.g., welded, bolted, and/or the like). The third projection portion 144 includes a through aperture 142. The first projection rail 148 also includes a fourth projection portion 146 which is substantially identical to the third projection portion 144, and which is fixedly coupled to rail 148 in a conventional manner (e.g., welded, bolted, and/or the like). The fourth projection portion 146 includes a through aperture 140 which is substantially identical to the through aperture 142 of the third projection portion 144.

The third pin 134 which was disposed through the third pair of opposing apertures 137 is further disposed through the apertures 140, 142 of the respective third and fourth projection portions 144, 146, thereby movably coupling the second cardan 136 to the first projection rail 148.

As briefly discussed above, the remaining two of the four substantially identical apertures 114 of the first plate 112 are formed through the bottom portions of the legs 116, 118 and, the remaining two of the four substantially identical apertures 130 of the second plate 124 are formed through the top portions of the legs 126, 128. Particularly, the joint 100 further includes a fifth pin or "center" pin 122 which is disposed through the apertures 114 of the bottom portions of the legs 116, 118 and then the pin 122 is further disposed through the apertures 130 of the top portions of the legs 126, 128, thereby movably coupling the first plate 112 to the second plate 124. In this manner, the center beam 28 may be selectively movable in a rotational motion by actuating the first and second plates 112, 124 respectively, from a first non-actuated position wherein the legs 116, 118 of the plate 112 are substantially perpendicular to the legs 126, 130 of the second plate to a second actuated position wherein the legs 116, 118 of the first plate are substantially parallel to the legs 126, 128 of the second plate 124.

It should be appreciated that the double cardan joint 100 which is illustrated in FIG. 3 is configured to be disposed in close proximity to the beam 28 and in close proximity to the beam 14. It should also be appreciated that the double cardan joint which is configured to be disposed upon the opposite side of the beam 28 (i.e., in close proximity to the beam 12) is substantially identical to the double cardan joint 100 with the exception that the first and second projection portions 102, 104 will be operatively positioned upon the bottom of the beam 28 and at an angle which is substantially perpendicular to the angle of the projection portions 102, 104 which are shown in FIG. 3.

It should also be appreciated that in other non-limiting embodiments of the invention, both of the substantially identical double cardan joints 100 may each be replaced by a pair of conventional pulleys. That is, as should be appreciated by one who is skilled in the relevant art, each of the high tension cables 90, 92 would be threaded through a respective first pulley (i.e., the first pulley would be in a location which the fifth pin 122 is in) and through a second respective pulley which would be in a location which is substantially near the projections 102, 104. In this manner, an actuation of the cables 90, 92 would cause the pulleys to redirect the cables to pull upon the beam 28, effective to move the beam rotationally.

It should be further appreciated that nothing within this description is meant to or should be construed as limiting the present invention to only employing two double cardan joints 100 or a pulley system. Rather, the present invention may employ substantially any desired type joint. For example and without limitation, the present invention may employ a pair of conventional servo-motors, a hydraulic system, and/or the like.

In operation, a user would first adjust the apparatus 10 to comfortably receive and support his/her body. That is, a user may selectively adjust the pins 40, 41 to a position which either increases or decreases the length of the center beams 28, 38, 46. Next, the user may selectively adjust the position of the beam 38 to a position which moves the generally trapezoidal extension collar 42 to a location which allows the user to comfortably rest his/her feel upon the collar 42. The user then may selectively adjust the Achilles' pad 50 by selectively rotating the threaded fastening device 51 (i.e., rotating the threaded fastening device 51 in either a clockwise or counter-clockwise rotational direction will raise or lower the Achilles' pad 50).

The user then may selectively adjust the tension of the cables 90, 92 by removing the pins (not shown) from the apertures 99 of the second extension arms 94. In this manner, the cables 90, 92 may be uncoupled from the second extension arms 94 and re-coupled through one of the plurality of apertures 96 of the second extension arms 94, thereby selectively adjusting the tension of the cables 90, 92. Next, the user may selectively adjust the position of the elbow slings 84 by selectively sliding the elbow slings 84 within the slots 81 of the frame arms 80.

In other non-limiting embodiments, the user may selectively adjust the wrist pads 304, 306 of the arm 200 by selectively rotating the threaded dials 308, 310 in a counter-clockwise rotational direction (i.e., a counter-clockwise rotational direction will loosen the pads 304, 306 within the slots 300, 302, such that the pads 304, 306 may be selectively moved within the slots 300, 302 to a position which places the wrist pads 304, 306 upon the user's wrists.

Furthermore, in other non-limiting embodiments, the user may selectively adjust the head pad 365 to a desired inclination by selectively removing the pin (not shown) which is resident through the aperture 382 of the beam 62 and through one of the plurality of apertures 384 of the guide projection 380. The user then may selectively incline the head pad 365 and replace the pin (not shown) through a desired one of the plurality of apertures 384 of the guide projection 380 and through the aperture 382 of the beam 62, thereby selectively elevating the head pad 365.

Next, the user may then place his/her body upon the apparatus 10 while ensuring that his/her feet are isolated between the Achilles' pads 49, 50, and the foot pads 47, 48 while the user's feet are resting comfortably upon the generally trapezoidal extension collar 42.

Upon a user isolating his/her feet, the user may then comfortably position his/her buttocks within the generally arcuate buttocks pad 60 and gently recline his/her back until the user's back is comfortably resting upon and supported by the back pad 64. Next, the user may selectively rest his/her head upon the head pad 65 or, in other non-limiting embodiments, upon the head pad 365.

It should be appreciated that, upon completion of the user resting his/her head upon the head pad 65 (i.e., either the head pad 65 or the head pad 365), the user is completely supported by the apparatus 10 and within a substantially prone position.

Next, the user then may selectively reach towards and through the frame arms 80 and rest both of his/her elbows upon the elbow slings 84: The user then may bend his/her arms at the elbows and grasp the handle grips 82. Upon completion of the user grasping the handle grips 82, the user is then ready to begin utilizing the apparatus 10.

A user of the apparatus 10 may either selectively pull upon one of the handle grips 82 which forces the user's elbow towards the user's knee and, in this manner, the second extension arm 94 moves in a direction away from the support pillars 20, 24. It should be appreciated that, in this manner, tension is applied to a respective one of the high tension cables 90, 92 (i.e., if the user is pulling upon the handle 82 with his/her right arm, then tension will be applied to the cable 92 and if the user is pulling upon the handle 82 with his/her left arm, then tension will be applied to the cable 90).

The following description of the operation of the apparatus will be in reference to a user pulling upon the handle grip 82 with his/her right hand.

Upon tension being applied to the high tension cable 92, the cable 92 then pulls upon the pin 122 of the double cardan joint in a direction towards the user's head. The pulling of the pin 122 is effective to force the first and the second plates 112, 124 to become substantially parallel to each other and, this motion is effective to cause the first plate 112 to push upon the first pin 108, which, in turn, forces the first and second projection portions 102, 104 upwards or in a clockwise rotational motion. This clockwise rotational motion rotates the center beams 28, 38, 46 in a clockwise rotational motion, which also rotates the buttocks pad 60, the thigh pads 56, 58, the Achilles' pads 49, 50, the foot pads 47, 48, and the collar 42 in a clockwise rotational motion.

It should be understood that a pull upon the handle 82 with a user's right hand/arm causes the user's small of the back, hips, legs, and feet to move in a rotational direction away from the user's right arm (i.e., the user's left hip will move rotationally downward while the user's right hip will move rotationally upward), thereby exercising the user's lower body in the tensile mode.

It should be further understood that a pull upon the handle grip 82 with the users left hand/arm will cause an equal and opposite reaction. That is, the user's left hip will move rotationally upward while the user's right hip will move rotationally downward (i.e., the beam 28 will move in a counter-clockwise rotational direction), thereby exercising the user's lower body in the tensile mode.

It should be appreciated that the user's upper body (i.e., chest, arms, back, abdominal muscles, and the like) will also benefit from the apparatus 10 by conventional resistance training.

It should be understood that this invention is not limited to the exact construction or embodiments listed and described, but that various changes may be made without departing from the spirit and scope of the invention.

What is claimed is:

1. A method for exercising an individual in both a tensile and a compression mode, said method comprising the steps of:

providing a first rigid frame assembly, providing a second selectively rotatable frame assembly and coupling said second selectively rotatable frame to said first rigid frame assembly, providing a seat portion and coupling said seat portion to said second selectively rotatable frame assembly, providing a pair of independent and selectively rotatable handle portions, and providing a pair of high-tension cables and coupling said pair of high-tension cables to a respective one of said pair of selectively rotatable handle portions, causing a movement of a first handle of said pair of handles to rotate said seat portion in a first direction, and causing a movement of a second handle of said pair of handles to rotate causes said seat portion to rotate in a second direction, providing a first arm frame and disposing a first of said pair of handle portions within said first arm frame, providing a second arm frame and disposing a second of said pair of handle portions within said second arm frame, providing a first and second selectively adjustable elbow sling, disposing said first selectively adjustable elbow sling within said first arm frame, disposing said second selectively adjustable elbow sling within said second arm frame, allowing said individual to place a first elbow within said first elbow sling and grasp said first handle with a first hand, allowing said individual to place a second elbow within sling and grasp said second handle with a second hand, providing an axle portion having a first side and a second side and coupling said axle portion to said first rigid frame assembly, providing a first shock absorption joint having a first aperture formed there through and causing said first side of said axle portion to receive said first shock absorption joint through said first aperture, providing a second shock absorption joint having a second aperture formed there through and causing said second side of said axle portion to receive said second shock absorption joint through said second aperture, providing a first extension arm having a first end and a second end, coupling said first end of said first extension arm to said first arm frame and coupling said second end of said extension arm to said first shock absorption joint, providing a second extension arm having a first end and a second end coupling said first end of said second extension arm to said second arm frame and coupling said second end of said second extension arm to said second shock absorption joint, providing a third extension arm having a first end, a second end, and a plurality of through apertures, coupling said first end of said third extension arm to said first shock absorption joint, providing a fourth extension arm having a first end and a second end, coupling said first end of said fourth extension arm to said second shock absorption joint, and coupling each of a pair of high tension cables to a respective one of said third and fourth extension arms through one of said plurality of apertures of said third and fourth extension arms.

2. The method of claim 1 further comprising the steps of:

providing a first plurality of support pads which are each ergonomically contoured to receive and support a respective portion of a user's upper body;

providing a second plurality of support pads which are each ergonomically contoured to receive and support a respective portion of a user's lower body;

coupling said first plurality of support pads to said first rigid frame assembly;

coupling said second plurality of support pads to said second selectively rotatable frame assembly; and allowing said first and said second plurality of support pads to receive and support said individual.

3. The method of claim 1 wherein said step of providing a second plurality of support pads further includes the steps of:

providing a first ergonomically contoured foot pad and disposing said first foot pad upon a first side of said second selectively rotatable frame assembly;

providing a second ergonomically contoured foot pad and disposing said second foot pad upon a second side of said second selectively rotatable frame assembly;

providing a first selectively movable and ergonomically contoured Achilles' pad and disposing said first Achilles' pad upon said first side of said second selectively rotatable frame assembly and in close proximity to said first ergonomically contoured foot pad; and providing a second selectively movable and ergonomically contoured Achilles' pad and disposing said second Achilles' pad upon said second side of said second selectively rotatable frame assembly and in close proximity to said second ergonomically contoured foot pad.

4. The method of claim 1 further comprising the steps of:

providing a pair of actuation assemblies and coupling said pair of actuation assemblies to said first rigid frame and to said second selectively rotatable frame assembly.

5. The method of claim 4 further comprising the steps of:

coupling a first of said pair of actuation assemblies on a first side of said second selectively rotatable frame assembly: and coupling a second of said pair of actuation assemblies on a second side of said second selectively rotatable frame assembly.

6. The method of claim 5 further comprising the step of coupling each of said pair of high tension cables to a respective one of said pair of actuation assemblies.

7. The method of claim 6 further comprising the steps of:

permitting said individual to isolate a first foot between said first Achilles' pad and said first foot pad;

permitting said individual to isolate a second foot between said second Achilles' pad and said second foot pad;

permitting said individual to selectively rotate said first arm frame, thereby actuating a first of said pair of actuation assemblies, effective to rotate said second selectively rotatable frame assembly in a direction which is away from said first arm frame; and permitting said individual to selectively rotate said second arm frame, thereby actuating a second of said pair of actuation assemblies, effective to rotate said second selectively rotatable frame assembly in a direction which is away from said second arm frame.

8. The method of claim 7 further comprising the steps of:

providing a selectively actuatable rotational retardation assembly; and coupling said selectively actuatable rotational retardation assembly to said second selectively rotatable frame assembly, thereby allowing said individual to selectively retard a rotational movement of said second selectively rotatable frame assembly.

* * * * *